US006324971B1

(12) United States Patent
Urban

(10) Patent No.: US 6,324,971 B1
(45) Date of Patent: Dec. 4, 2001

(54) GOLF BALL MARKING DEVICE AND GOLF PUTTING ALIGNMENT SYSTEM

(76) Inventor: Gerald C. Urban, 14557 Eagle Ridge Dr., Fort Myers, FL (US) 33912

( * ) Notice: Subject to any disclaimer, the term of this patent is extended or adjusted under 35 U.S.C. 154(b) by 0 days.

(21) Appl. No.: 09/417,718

(22) Filed: Oct. 13, 1999

Related U.S. Application Data

(60) Provisional application No. 60/145,267, filed on Jul. 26, 1999.

(51) Int. Cl.[7] ..... B41F 17/00

(52) U.S. Cl. ..... 101/35; 101/4; 101/DIG. 40; 473/285; 473/406

(58) Field of Search ..... 101/35, 114, 119, 101/124, 129, DIG. 40, 4; 400/128; 73/65.02; 473/406, 285; 224/918

(56) References Cited

U.S. PATENT DOCUMENTS 1,999,647 * 4/1935 Atti ..... 400/128 X
2,616,368 * 11/1952 Hochman ..... 101/333
3,019,762 * 2/1962 Hautz ..... 101/35 X
3,161,041 * 12/1964 Amburgey ..... 73/65.02
4,086,851 * 5/1978 Brandell ..... 101/4
4,546,644 * 10/1985 Beny et al. ..... 73/65.2
5,758,790 * 6/1998 Ewing, Jr. ..... 215/384
5,795,249 * 8/1998 Johnson ..... 473/406

* cited by examiner

*Primary Examiner*—John S. Hilten
*Assistant Examiner*—Minh Chau
(74) *Attorney, Agent, or Firm*—Tipton L. Randall

(57) ABSTRACT

A device for inscribing a mark on a circumference of a golf ball is disclosed. The device is a rigid hollow cylindrical member of selected internal diameter with internal and external surfaces, and with a closed end and an open end. The open end has an open end surface having a bevel on an edge adjacent the hollow cylindrical member internal surface. The hollow cylindrical member selected internal diameter is sized to accept and support a golf ball with the golf ball circumference positioned adjacent the cylindrical member open end bevel edge. A user supports a golf ball on the hollow cylindrical member open end, and inscribes a visible mark on at least a portion of the golf ball circumference with a marking device. Also disclosed is a method of using the novel device.

10 Claims, 4 Drawing Sheets

GOLF BALL MARKING DEVICE AND GOLF PUTTING ALIGNMENT SYSTEM

CROSS-REFERENCE TO RELATED APPLICATIONS, IF ANY

This application claims the benefit under 35 U.S.C. §119 (e) of co-pending provisional application Ser. No. 60/145,267, filed Jul. 26, 1999. application Ser. No. 60/145,267 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device for inscribing a mark on a circumference of a golf ball, as well as to a process for using the device to mark a golf ball.

2. Background Information

Golf is a popular hobby for many individuals. The area around each hole of a golf course, known as the green, is smooth but often has a number of slopes and undulations. On the green surface, a player normally uses a short flat faced club called a putter to gently propel the golf ball toward and into the hole. The player on occasion must aim the golf ball directly at the hole when putting. More often, however, the player must aim the ball at a point slightly removed from the hole to compensate for the slope of the green. In aiming the golf ball toward the hole, it is useful to have a mark or line on the circumference of the golf ball for alignment with the target, and to strike the golf ball with the putter head such that the putter club face is perpendicular to the ball circumference, and thus the line thereon, thereby propelling the ball toward the target. Golf balls often have printing or similar markings on the ball circumference that may be useful in the above described putting alignment. These marks are often small and difficult to see. Applicant has invented a device that is useful for inscribing a highly visible mark on a circumference of a golf ball, as well as a method of using the device for this purpose.

SUMMARY OF THE INVENTION

The invention is a device for inscribing a mark on a circumference of a golf ball. The device comprises a rigid hollow cylindrical member of selected internal diameter with internal and external surfaces, and with first and second ends. At least one cylindrical member end is open with an open end surface having a bevel on an edge adjacent the hollow cylindrical member internal surface. The hollow cylindrical member selected internal diameter is sized to accept and support a golf ball with the ball circumference positioned adjacent the cylindrical member open end bevel edge. A user supports a golf ball on the hollow cylindrical member open end and inscribes a visible mark on at least a portion of the ball circumference. A method of using the device is also disclosed.

DESCRIPTION OF THE PREFERRED EMBODIMENTS

Nomenclature

Figure 1:
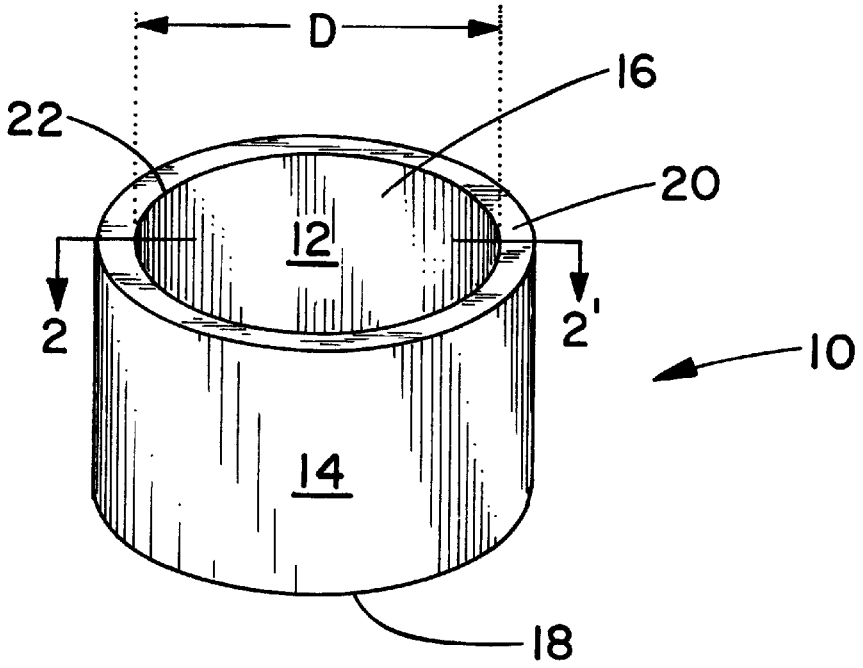
FIG. 1 is a perspective elevational view of one embodiment of the present invention.
Figure 2:
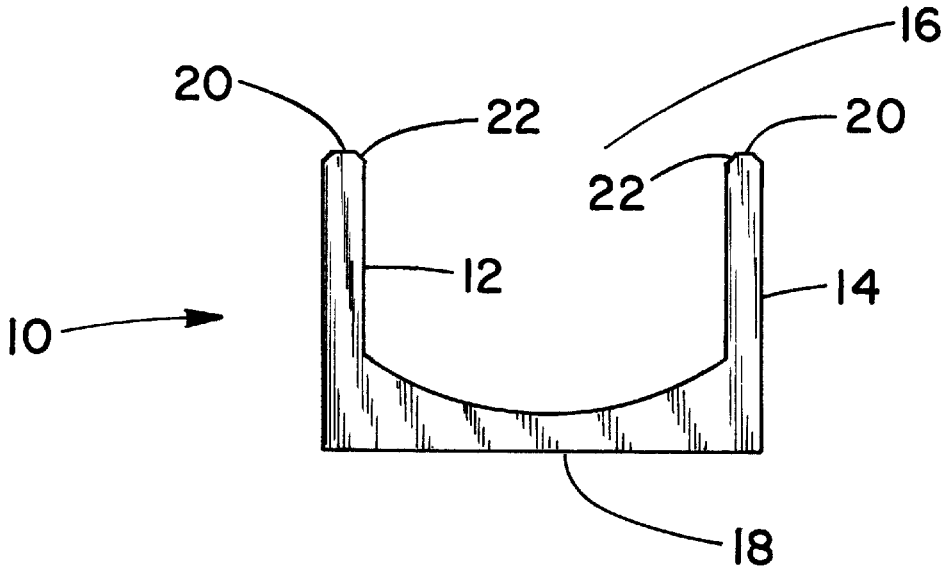
FIG. 2 is a cross sectional view of the one embodiment of FIG. 1 along line 2–2'.
Figure 3:
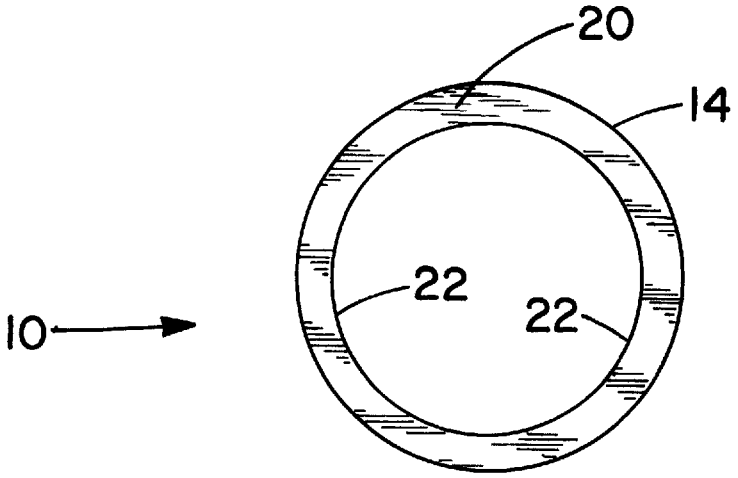
FIG. 3 is a top view of the one embodiment of FIG. 1.
Figure 4:
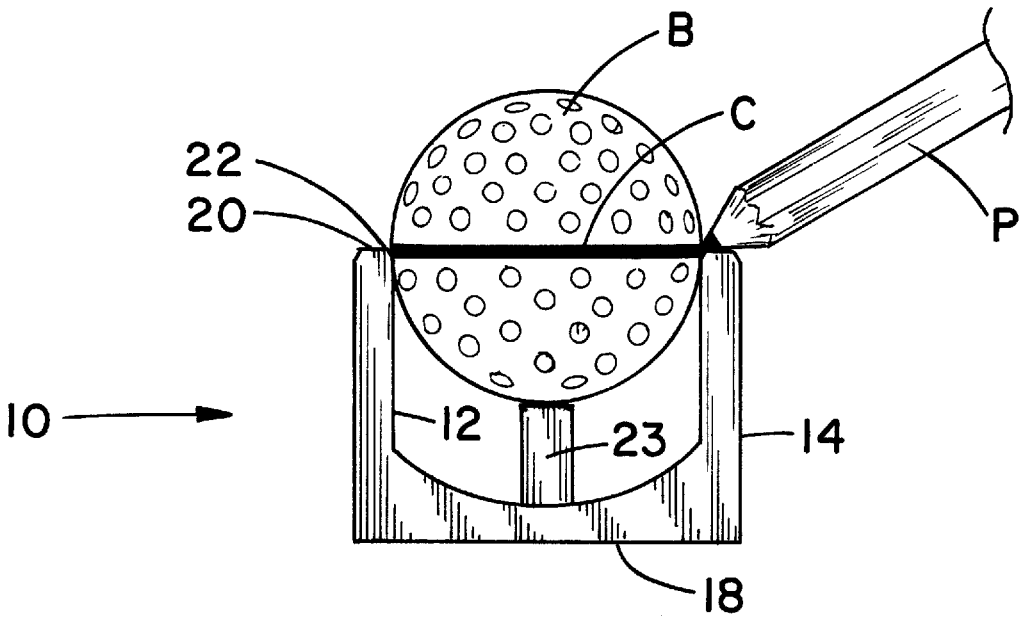
FIG. 4 is a cross sectional view of the one embodiment of FIG. 1 with a ball being marked.
Figure 5:
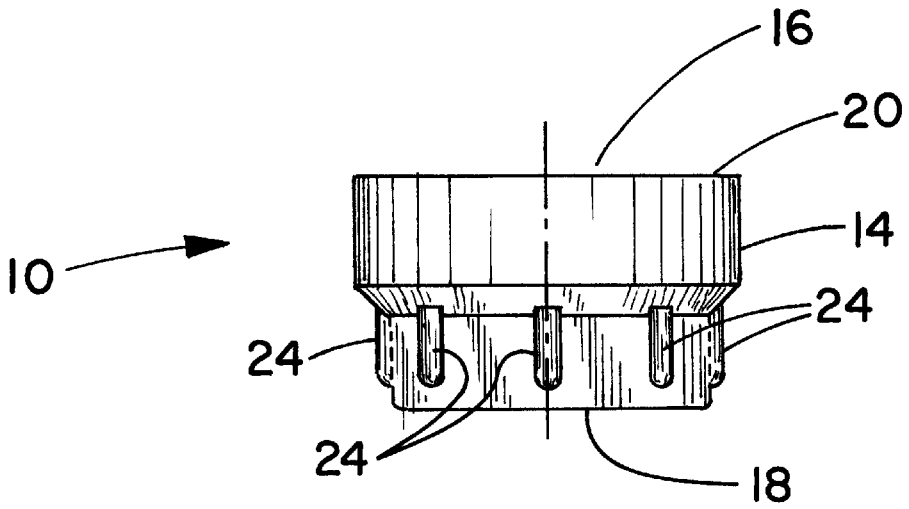
FIG. 5 is a perspective elevational view of another embodiment of the present invention.
Figure 6:
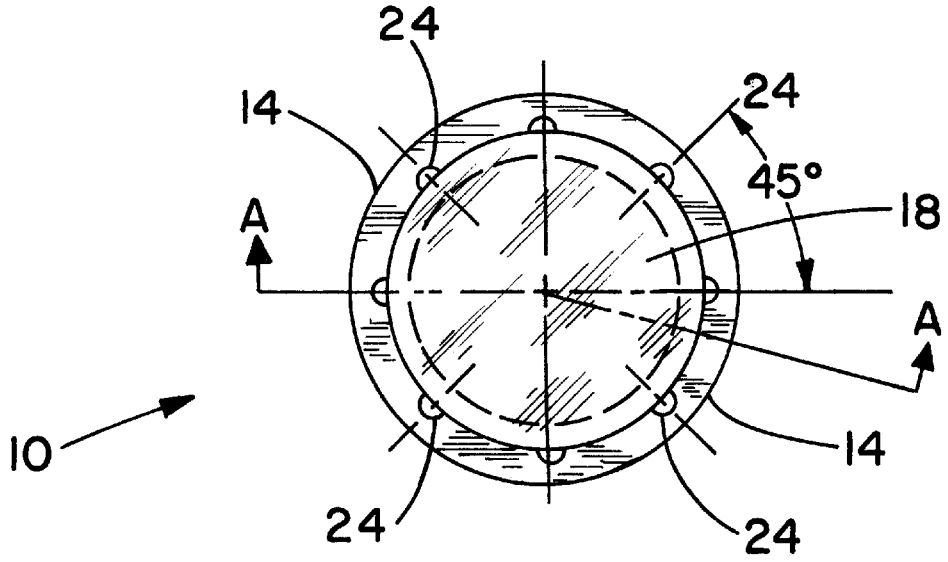
FIG. 6 is a plan bottom view of the embodiment of FIG. 5.
Figure 7:
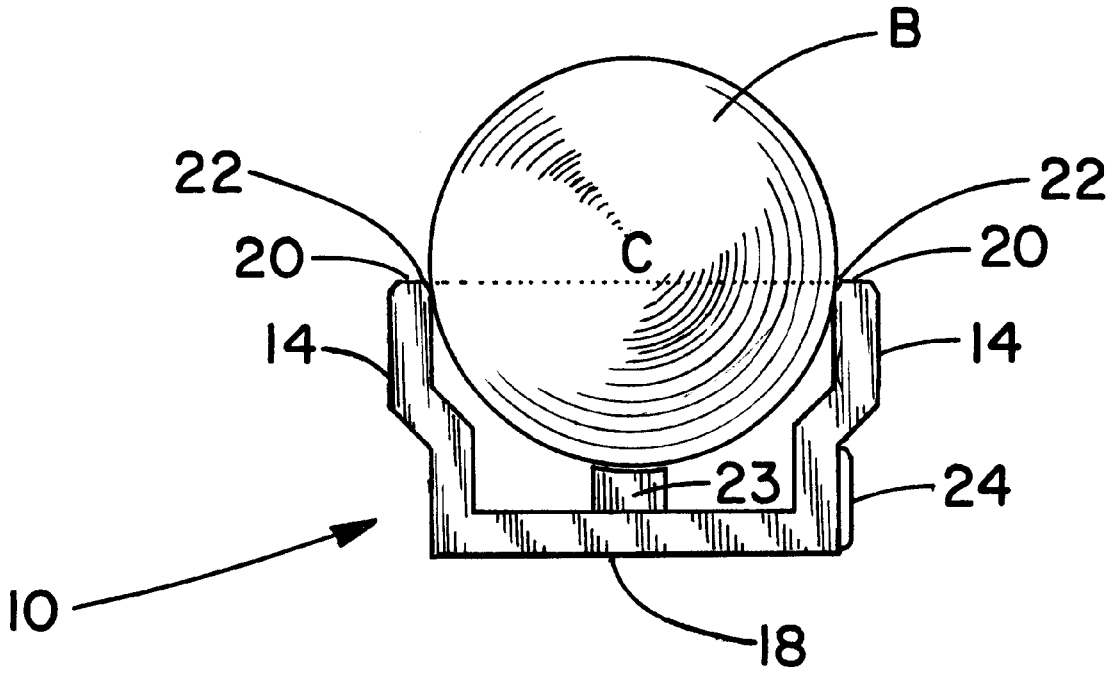
FIG. 7 is a cross sectional view of the embodiment of FIG. 5 holding a golf ball.

10 Rigid Hollow Cylindrical Member
12 Internal Surface of Cylindrical Member
14 Exterior Surface of Cylindrical Member
16 Open First End of Cylindrical Member
18 Second End of Cylindrical Member
20 End Surface of Open End of Cylindrical Member
22 Beveled Edge of Open End Surface
23 Support Peg Member
24 Raised Ridge Members on External Surface of Cylindrical Member
B Golf Ball
C Circumference of Golf Ball
D Internal Diameter of Cylindrical Member
P Inscribing Marker Construction Referring to FIGS. 1–4, one embodiment of the present invention is shown. The device comprises a rigid, hollow cylindrical member 10 of selected internal diameter D with an internal surface 12 and an external surface 14. The cylindrical member 10 has a first end 16 and a second end 18, with at least one cylindrical member end being open with an open end surface 20. Although both ends 16, 18 of the hollow cylindrical member 10 may be open, it is preferred that just one end be open. In the embodiment of the invention shown in FIGS. 1–4, the first end 16 is open and the second end 18 is closed. The at least one open end surface 20 has a beveled edge 22 adjacent the hollow cylindrical member internal surface 12. The hollow cylindrical member selected internal diameter D is sized to accept and support a golf ball B with the golf ball circumference C positioned adjacent the cylindrical member open end beveled edge 22. The hollow cylindrical member 10 is of sufficient length that half of the golf ball B can be positioned within the cylindrical member 10 without contacting the cylindrical member closed second end 18. The user supports a golf ball B on the hollow cylindrical member open end 16 and inscribes a visible mark on at least a portion of the golf ball circumference C. The mark may be inscribed using a marking pen P with a pointed tip, as shown in FIG. 4. The beveled edge 22 of the open end 16 allows the user to move the marking pen P along a portion or all of the cylindrical member open end 16, marking the ball circumference C without smudging the mark as the marking pen P moves along. The rigid, hollow cylindrical member 10 is preferably sized so that the user can hold both the cylindrical member 10 and the supported golf ball B with one hand and hold the marking pen P with the other hand to inscribe a mark on the circumference C of the golf ball B.

In some instances it is desirable to include a support peg member 23 protruding from the center of the closed second end 18 of the hollow cylindrical member 10, projecting toward the cylindrical member open first end 18. The support peg member is sized to just contact and further support the golf ball B as the ball contacts the cylindrical member beveled edge 22.

The rigid, hollow cylindrical member 10 may be fabricated from a variety of rigid materials. Examples of rigid materials include metal, wood, stone, and preferably, synthetic polymeric resin material. Most preferably, the cylindrical member 10 is fabricated from polyvinyl chloride resin, based upon the economy of this material and the ability to produce a device of consistent dimensions.

Referring to FIGS. 4–7, another embodiment of the present invention is shown. The embodiment of FIGS. 4–7 comprises a rigid, hollow cylindrical member 10 of selected internal diameter D with an internal surface 12 and an external surface 14. The cylindrical member 10 has a first open end 16 and a second closed end 18, with the open end having an open end surface 20. The open end surface 20 has a beveled edge 22 adjacent the hollow cylindrical member internal surface 12. The hollow cylindrical member selected internal diameter D near the open end 16 is sized to accept and support a golf ball B with the golf ball circumference C positioned adjacent the cylindrical member open end beveled edge 22. The hollow cylindrical member 10 is of sufficient length that half of the golf ball B can be positioned within the cylindrical member 10 without contacting the cylindrical member closed second end 18. The user supports a golf ball B on the hollow cylindrical member open end 16 and inscribes a visible mark on at least a portion of the golf ball circumference C. The mark may be inscribed using a marking pen P with a pointed tip. The beveled edge 22 of the open end 16 allows the user to move the marking pen P along a portion or all of the cylindrical member open end 16, marking the ball circumference C without smudging the mark as the marking pen P moves along.

In some instances it is desirable to include a support peg member 23 protruding from the center of the closed second end 18 of the hollow cylindrical member 10, projecting toward the cylindrical member open first end 18. The support peg member is sized to just contact and further support the golf ball B as the ball contacts the cylindrical member beveled edge 22.

The rigid, hollow cylindrical member 10 is preferably sized so that the user can hold both the cylindrical member 10 and the supported golf ball B with one hand and hold the marking pen P with the other hand to inscribe a mark on the circumference C of the golf ball B. In this embodiment, the diameter of the closed end 18 is slightly less than the selected diameter D of the open end 16 that accepts and supports the golf ball B. The smaller diameter second end 18 of the cylindrical member 10 preferably has a plurality of raised ridge members 24 evenly spaced around the exterior surface 14 of the bottom end 16 of the cylindrical member 10. The raised ridge members 24 provide enhanced gripping of the cylindrical member 10 by the hand of the user.

The rigid, hollow cylindrical member 10 of this embodiment may be fabricated from a variety of solid materials. Examples of rigid materials include metal, wood, stone, and preferably synthetic polymeric resin material. Most preferably, the cylindrical member 10 is fabricated from polyvinyl chloride resin, base upon the economy of this material and the ability to produce a device of consistent dimensions.

A method of marking a circumference of a golf ball is also included in the present invention. The method includes providing a rigid hollow cylindrical member of selected internal diameter with internal and external surfaces, and with a closed end and an open end, the open end with an open end surface having a beveled edge adjacent the hollow cylindrical member internal surface, with the hollow cylindrical member of selected internal diameter sized to accept and support the golf ball with the golf ball circumference positioned adjacent the cylindrical member open end bevel edge. The user supports the golf ball on the hollow cylindrical member open end inscribes a visible mark on at least a portion of the golf ball circumference with a marking device.

Concerning the inscribing of a line on all or a portion of the circumference of a golf ball, this practice is allowed under the rules of the United States Golf Association (USGA).

While the invention has been particularly shown and described with reference to preferred embodiments thereof, it will be understood by those skilled in the art that various changes in form and details may be made therein without departing from the spirit and scope of the invention.

I claim:

1. A device for inscribing a mark on a circumference of a golf ball comprising;

a rigid hollow cylindrical member of selected internal diameter with internal and external surfaces, and with a closed end and an open end, said open end with an open end surface having a beveled edge adjacent said hollow cylindrical member internal surface;

a centrally positioned interior support peg member projecting toward said cylindrical member open end from said cylindrical member closed end for supporting a golf ball;

said hollow cylindrical member selected internal diameter sized to accept and support the golf ball with the golf ball circumference positioned adjacent said cylindrical member open end beveled edge;

whereby a user supports the golf ball on said hollow cylindrical member open end and inscribes a visible mark on at least a portion of the golf ball circumference adjacent the open end beveled edge.

2. The golf ball marking device of claim 1, further comprising, a plurality of raised ridge members on said hollow cylindrical member external surface.

3. The golf ball marking device of claim 2 wherein said plurality of raised ridge members are symmetrically spaced around said hollow cylindrical member external surface adjacent said closed end.

4. The golf ball marking device of claim 1 wherein, said rigid hollow cylindrical member is fabricated from polymeric resin material.

5. The golf ball marking device of claim 4 wherein, said polymeric resin material is polyvinyl chloride.

6. A device for inscribing a mark on a circumference of a golf ball comprising;

a rigid hollow cylindrical member of selected internal diameter with internal and external surfaces, and with a closed end and an open end, said open end with an open end surface having a beveled edge adjacent said hollow cylindrical member internal surface;

a centrally positioned interior support peg member projecting toward said cylindrical member open end from said cylindrical member closed end for supporting a golf ball;

said hollow cylindrical member selected internal diameter sized to accept and support the golf ball with the golf ball circumference positioned adjacent said cylindrical member open end beveled edge; and a plurality of raised ridges on said hollow cylindrical member external surface;

whereby a user supports a golf ball on said hollow cylindrical member open end and inscribes a visible mark on at least a portion of the golf ball circumference adjacent the open end beveled edge.

7. The golf ball marking device of claim 6 wherein said plurality of raised ridge members are symmetrically spaced around said hollow cylindrical member external surface adjacent said closed end.

8. The golf ball marking device of claim 6 wherein, said rigid hollow cylindrical member is fabricated from polymeric resin material.

9. The golf ball marking device of claim 8 wherein, said polymeric resin material is polyvinyl chloride.

10. A method of marking a circumference of a golf ball comprising the steps;

(a) providing a rigid hollow cylindrical member of selected internal diameter with internal and external surfaces, and with a closed end and an open end, said open end with an open end surface having a beveled edge adjacent said hollow cylindrical member internal surface, and a centrally positioned interior support peg member projecting toward said cylindrical member open end from said cylindrical member closed end for supporting a golf ball; said hollow cylindrical member selected internal diameter sized to accept and support the golf ball with the golf ball circumference positioned adjacent said cylindrical member open end bevel edge;

(b) supporting the golf ball on said hollow cylindrical member open end; and (c) inscribing a visible mark on at least a portion of the golf ball circumference adjacent the open end beveled edge with a marking device.

* * * * *